United States Patent [19]

Guzzi

[11] 4,249,462

[45] Feb. 10, 1981

[54] METHOD AND APPARATUS FOR PREVENTING ICE FORMATION AT THE ENTRANCE PORTAL OF A MINE

[76] Inventor: Louis A. Guzzi, R.D. 5, Box 206, Johnstown, Pa. 15905

[21] Appl. No.: 960,823

[22] Filed: Nov. 15, 1978

[51] Int. Cl.[3] ..... E21F 1/00

[52] U.S. Cl. ..... 98/50; 98/36; 165/DIG. 12

[58] Field of Search ..... 98/50, 48, 36; 165/DIG. 2, DIG. 12; 299/19; 405/132

[56] References Cited

U.S. PATENT DOCUMENTS

| | | | |
|---|---|---|---|
| 906,872 | 3/1908 | Groling | 98/50 |
| 1,185,453 | 5/1916 | Walker | 98/49 |
| 1,280,254 | 10/1918 | Lide | 98/50 |
| 1,586,660 | 6/1926 | Dodds | 98/50 |
| 2,152,172 | 3/1939 | Bartlett | 98/50 |
| 2,523,273 | 10/1946 | Blundell | 98/50 |
| 2,859,682 | 11/1958 | Joy | 98/50 |
| 3,687,053 | 8/1972 | Henson et al. | 98/36 |
| 4,119,142 | 10/1978 | Margen | 165/DIG. 12 |

FOREIGN PATENT DOCUMENTS

| | | | |
|---|---|---|---|
| 1168850 | 4/1964 | Fed. Rep. of Germany | 98/50 |

*Primary Examiner*—Henry C. Yuen
*Assistant Examiner*—Henry Bennett
*Attorney, Agent, or Firm*—Sidney W. Millard

[57] ABSTRACT

To prevent the formation of ice at the inlet portal of a mine and to heat air during the winter season, air is heated and forced into the mine shaft near the entrance portal at a pressure greater than atmospheric.

3 Claims, 2 Drawing Figures

METHOD AND APPARATUS FOR PREVENTING ICE FORMATION AT THE ENTRANCE PORTAL OF A MINE

BACKGROUND OF THE INVENTION

In a conventional mine shaft the ventilation system incorporates one or more inlets with an exhaust duct through an underground network of shafts and tunnels. In practice, air is drawn through the inlets down into the mine shaft, circulated throughout the network, withdrawn through the exhaust duct and exhausted to the atmosphere. A fan is incorporated in the outlet duct to draw the air from the mine and exhaust it to the outside. This creates a vacuum or negative pressure within the mine and air from the atmosphere rushes in through the inlets to fill the void. Unfortunately, during the winter season the cold air (often below 0° C.) drawn into the mine at the entrance portal tends to freeze water collected on the floor of the mine. Traditionally tracks are laid on the floor of the shaft to transport miners and machinery. Ice formation on the tracks prevents the proper operation of the track mounted, mechanized mining apparatus. Ice is formed when frigid air being drawn into the mine comes into contact with the warmer and moist air inside the mine and the moisture is condensed. Droplets collect on the steel tracks much as they do on a glass of iced tea in the summer. The droplets subsequently freeze causing the tracks to become impassable. The colder the outside air the greater the amount of condensation and the greater the difficulties. Because mine shafts traditionally are inclined downward into the body of the mine, a certain amount of the melted ice and snow will flow downhill into the mine shaft.

In more severe winters the air being drawn into the mine by the conventional ventilating system is so cold that miners have complained about the temperature. The complaints are really based on the location of the individual miner. The closer the miner is to the inlet portal, the colder is the bulk temperature of the air. The relative comfort of the miner is important but it was not the prime problem to be solved. The problem is the ice formation at the mouth or entrance portal of the mine. The traditional way the ice is removed is by pick and shovel to remove the large chunks and oil burners and salt are used to complete the job. The time consumption, high labor costs and the deterioration of the tracks as a result of the salt usage is rather substantial.

SUMMARY OF THE INVENTION

This invention solves the problem by injecting heated air into the entrance portal area of the mine shaft at a temperature, pressure and volume which will maintain the air at the floor of the shaft near the entrance portal at a temperature above the freezing point of water. With these conditions the water will not freeze on the tracks and the problem is solved.

Objects of the invention will be clear from a detailed review of the description of the preferred embodiment.

DESCRIPTION OF THE PREFERRED EMBODIMENTS

Figure 1:
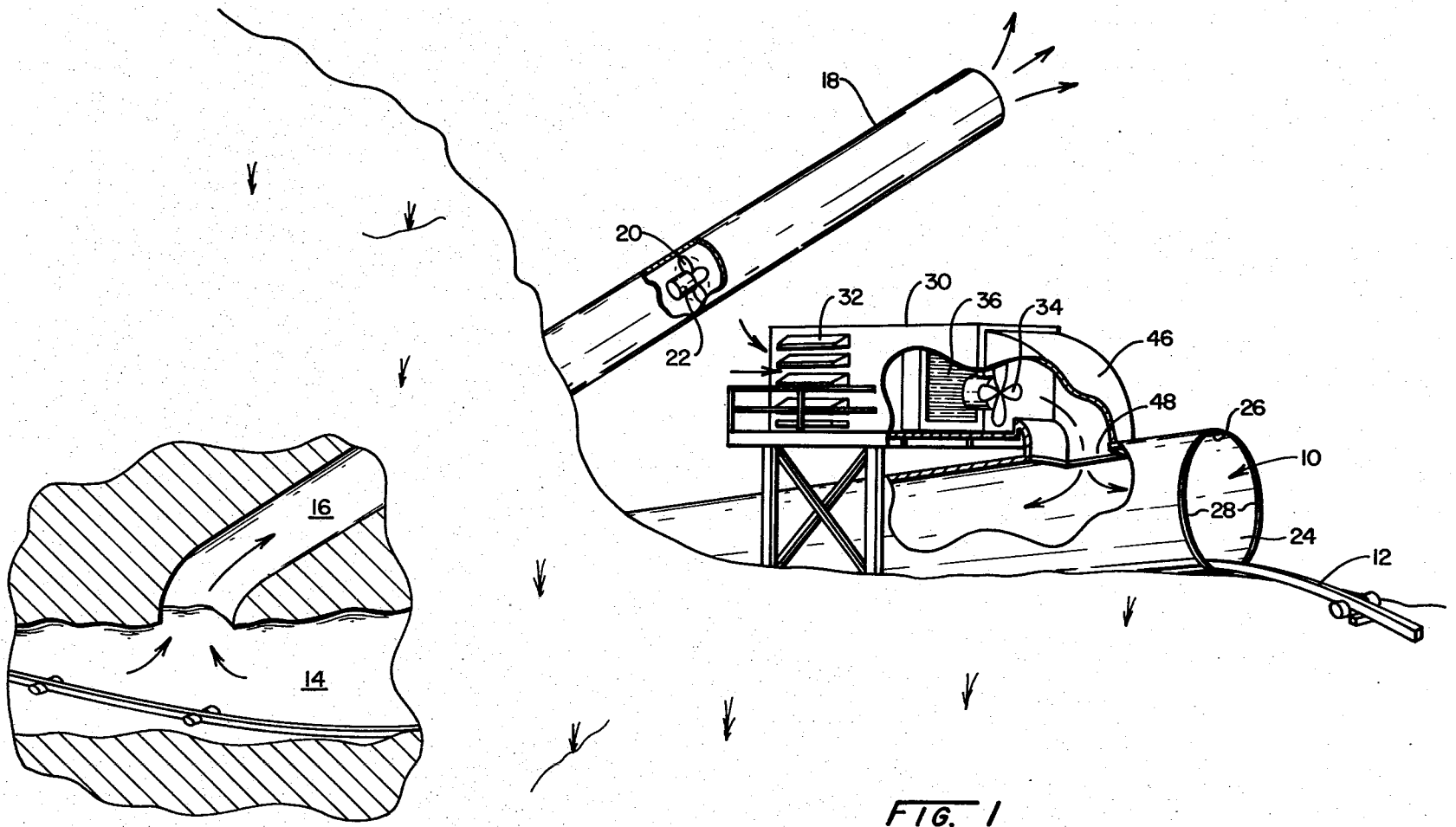
FIG. 1 is a diagrammatic sketch of the inlet portal, exhaust duct and internal shaft of a mine and showing the air heating and forcing apparatus of this invention mounted near the inlet portal.

In underground mining operations it is necessary to have an inlet portal 10 for the miners and the mining machinery. Railroad tracks and their associated cars and driving mechanism are a traditional way of moving equipment and ore in and out of the mine and for illustrative purposes a monorail system of tracks 12 is illustrated. The inlet portal illustrated is circular but it is clear that the shape is not a part of this invention.

The mine shaft 14 extends from the portal 10 deep into the ground where the extraction of ore is taking place. Some place near the mining face there will be an exhaust shaft 16 for conveying air from deep within the mine to an outlet duct 18. A fan 20 mounted in the duct 18 is driven by motor 22 to ventilate the mine. Fan 20 withdraws air from exhaust shaft 16 and thereby creates a negative pressure within the mine shaft 14. Air from the atmosphere flows into the inlet portal 10 and down into the mine through shaft 14 to relieve the negative pressure. This works very well throughout the year for purposes of ventilation and conforms with all of the basic requirements of the Bureau of Mines. However, during the winter months, when the outside temperature is particularly low, problems of ice formation occur.

Deep in the mine the temperature is relatively uniform throughout the year, roughly 13° C. In most mines, water from small springs continually drains into the deeper portions of the shaft and is continually pumped out through piping systems, not shown. As a consequence of the standing or flowing water in the mine shaft the mine air is relatively humid. Also, because hot air rises and cold air drops, the air flowing from outside through portal 10 will flow in a layer nearest the floor 24 and the relatively warmer air from inside the mine will flow toward the portal in a layer near the roof 26.

With the water vapor condensing near the inlet portal 10, the water resulting will flow downhill into the mine shaft 14 except when the air outside the mine drops below freezing. At that point water droplets will tend to form on the relatively colder rails and back-up between cross ties where the frigid air will turn it into ice. The ice build-up increases as the temperature outside the mine drops and the ice build-up must be removed by some mechanism to allow the mining cars to get in and out of the portal 10. Various means have been used to remove or melt the ice including chipping away with pick axes, placing salamander type oil heaters hear the portal and sprinkling salt on the frozen areas. The chipping and shoveling away of ice is obviously time consuming and expensive. Using outside heating apparatus is also very expensive and when the temperature gets down much below freezing it becomes ineffective. The use of salt is only effective down to about 7° C. for purposes of melting the ice but even where it is effective it is tremendously corrosive to the steel tracks and to the floor 24 and sidewalls 28 of the galvanized steel entrance portal illustrated.

To solve the ice build-up problem, this invention has provided a system for maintaining the air near the floor of the shaft at a temperature above the freezing point of water. This is accomplished by forcing air into the shaft.

The apparatus for accomplishing this is mounted on top of the shaft in a housing 30 having louvred vents 32. Outside air is drawn into the housing 30 through louvred vents 32 by a second fan 34, and to raise the temperature of the frigid air to an acceptable level (10°–13° C.) it is pulled through a heat exchanger 36.

The specific means for heating the outside air to the desired temperature is optional. A boiler can be used to supply heat to exchanger 36, heat could be withdrawn from the waste water pit where it is pumped from the mine or heat can be extracted from the air in outlet duct 18 as it is exhausted from the mine. The latter is preferred.

Figure 2:
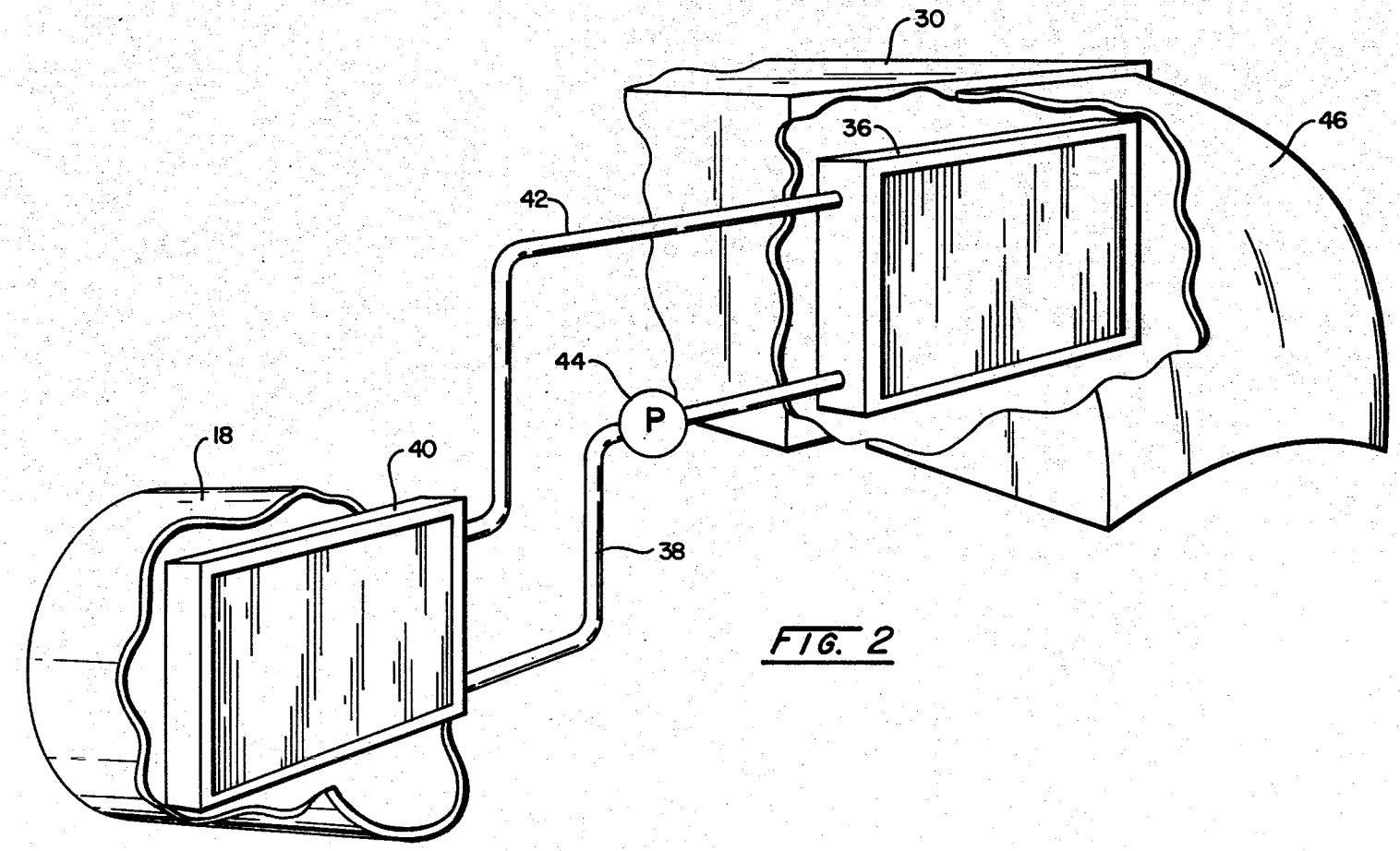
FIG. 2 is a schematic representation of a heat exchange system between the outlet duct and the forced air inlet feed.

Observing FIG. 2, heat is extracted from exchanger 36 and the cooler heat exchange fluid flows from exchanger 36 through piping 38 to a heat exchanger 40 mounted in outlet duct 18. Air being exhausted from the mine will heat the fluid in exchanger 40 and then it will be returned to exchanger 36 through piping 42. A pump 44 is shown for illustrative purposes.

Air heated by exchanger 36 is forced into shaft 14 through elbow 46 and shaft opening 48. Both the volume and temperature of the forced air are such that the air in the shaft 14 will be maintained above the freezing point of water. By way of illustration, in a typical mine, the exhaust fan 20 may be designed to exhaust 90,000 cubic feet per minute of air. In such a case the second fan 34 would be designed to force 100,000–110,000 cubic feet per minute of air through opening 48. Fan 34 must be designed to force the air into shaft 14 at greater than atmospheric pressure. This will insure that some of the air being forced into the shaft will flow out of the portal 10 and thereby preclude almost all of the outside colder air from entering the portal.

Air is heated to a temperature of 10°–13° C. by exchanger 36 and under these circumstances the water which may condense in the mine shaft 14 will not be subjected to below freezing temperatures. Accordingly, no ice will form on the inside of the mine, that is, inside the portal. Additionally, because the vast majority of the air exiting the portal is the recently heated air from outside the mine, its moisture content will be essentially identical to that of the outside air. As a consequence, there will be very little resulting condensation of water as the warmer air exits the portal 10.

It has been found preferable to force about 110–120% of the air through elbow 44 as is exhausted from duct 18 although slightly less than 110% might be acceptable when the temperature is above 0° C.

The location of the exit from opening 48 into shaft 14 is important from the standpoint of economics. As a general rule, the air being forced into the shaft 14 should be as near to the portal 10 as possible although it is acceptable to have the location of opening 48 as far as fifteen meters away. The preferred distance is about three meters. The reason for this is simple. A mine shaft is not air-tight. As a consequence, the exhaust fan 20 will be able to maintain a negative gauge pressure within the deeper parts of the mine at all times. There are many voids, crevasses and cracks throughout a mine shaft and there are numerous places for air to escape. Thus, most of the air from elbow 44 will flow downhill into the shaft 14. Only a very minor part will flow out of the portal 10. The further away from portal 10, the smaller will be the amount of air flowing out of portal 10. Fifteen meters has been the approximate distance where the flow of air out of portal 10 is essentially zero. Obviously if greater power is built into fan 34 while the identical fan 20 is retained, then the opening 48 can be located further from portal 10 but there appears to be no logical reason for increasing the power of fan 34 unless it is physically impossible to locate opening 48 near the inlet portal 10.

Having thus described the invention in its preferred embodiment, modifications will become obvious to those having ordinary skill in the art. Accordingly, it is not intended that the invention be limited by the words used to describe the same nor the drawings illustrating the preferred embodiment. Rather it is intended that the invention be limited only by the scope of the appended claims.

What is claimed is:

1. A method for preventing the formation of ice on the floor at the entrance of a mine shaft adjacent its inlet portal comprising:

forcing air into the shaft at a point located no greater than fifteen meters from the inlet portal, said air being at a pressure greater than atmospheric, exhausting air from said shaft through an exhaust duct, the volume of the forced air being about 110–120% of the air exhausted from the exhaust duct, heating the air being forced into said shaft prior to the time it enters said shaft, maintaining the air near the floor of the shaft at the inlet portal at a temperature above the freezing point of water, and delivering said forced air to the shaft at a location, volume, angle and pressure which combine to force some of said forced air out of the shaft through the inlet portal.

2. A method according to claim 1 wherein heat is extracted from the air exhausted from said exhaust duct and is transferred to said forced air before said forced air enters said shaft.

3. A method according to claim 1 wherein the temperature of said forced air is above 50° F. at the time it enters said shaft.

* * * * *